United States Patent [19]

Fraser

[11] 4,276,934

[45] Jul. 7, 1981

[54] METHOD AND DEVICE FOR BLOCKING WELLS TO EXTINGUISH FIRES, PROHIBIT SALTWATER INTRUSION, ETC.

[76] Inventor: Ward M. Fraser, 23309 Lockness Ave., Harbor City, Calif. 90710

[21] Appl. No.: 127,585

[22] Filed: Mar. 6, 1980

[51] Int. Cl.[3] ..... E21B 33/13

[52] U.S. Cl. ..... 166/286; 166/65 R; 166/117; 166/164; 166/169; 166/309; 166/295

[58] Field of Search ..... 166/286, 295, 292, 50, 166/164, 162, 169, 179, 180, 192, 104, 65 R, 117, 309; 175/72

[56] References Cited

U.S. PATENT DOCUMENTS

| | | | |
|---|---|---|---|
| 1,934,701 | 11/1933 | Edwards et al. | 166/286 |
| 2,609,880 | 9/1952 | Dyer | 166/117 |
| 3,141,513 | 7/1964 | Davis | 175/72 X |
| 3,190,373 | 6/1965 | Weathersby | 166/117 X |
| 3,346,049 | 10/1967 | Brown | 166/295 X |
| 3,417,824 | 12/1968 | Van Poollen | 166/117 |
| 3,726,340 | 4/1973 | Fraser | 166/117 |
| 4,083,406 | 4/1978 | Metz | 166/286 |

*Primary Examiner*—Stephen J. Novosad
*Attorney, Agent, or Firm*—Joseph Shulsinger

[57] ABSTRACT

A well, such as an oil well, may be plugged, on command, from the well head, by activating a plurality of preplaced motor-driven, foam generating capsules causing a foam to be generated and forced into the well hole where it hardens.

6 Claims, 4 Drawing Figures

METHOD AND DEVICE FOR BLOCKING WELLS TO EXTINGUISH FIRES, PROHIBIT SALTWATER INTRUSION, ETC.

BACKGROUND OF THE INVENTION

1. Field of the Invention

This invention relates to devices and methods for blocking or plugging an oil well, or similar well, when required to extinguish fires, contain saltwater intrusion, and the like.

2. Description of the Prior Art

Most existing devices for plugging oil wells rely on either plugging the top of the well or forcing a material, such as concrete, down through the hole to the desired depth at the time plugging the hole becomes necessary. The first of these approaches is not effective in many instances because it is necessary to place the blockage much lower in the hole. The second method is extremely difficult especially under a "blowout" condition. Applicant's prior invention, U.S. Pat. No. 3,726,340 dated Apr. 10, 1973, provides an apparatus for the generation of a polyurethane type foam at a desired depth in the well. The present invention discloses an apparatus and method for utilizing such devices by preplacing them at a predetermined depth in the well.

SUMMARY OF THE INVENTION

A number of foam generating capsules of the general type disclosed in applicant's U.S. Pat. No. 3,726,340 may be placed at predetermined depths within the drill hole. This may be accomplished in any of a number of ways. One method is to cause the drill bit to be diverted from its normal path at a predetermined depth such as is done for slant drilling. After the drill has thus proceeded a short distance it may then be withdrawn leaving a cavity into which a foam generating capsule may be placed. The drilling operation then can continue without the drill being diverted, thus drilling past the cavity in which the foam generating capsule has been placed.

Another method is to dispose a number of foam generating capsules in a fixture of generally circular cylindrical shape. The outside diameter of this cylindrical fixture may be larger than the normal drill hole, but not so large as to be incapable of fitting within an oversized drill hole. The oversized hole may be drilled to the desired depth. The drill may then be removed and the fixture containing the foam generating capsules may be lowered within the oversized hole to the desired depth. A drill string of the normal diameter may then be passed through the center of the fixture and drilling may continue in a normal manner.

This latter method may also utilize the type of foam generating apparatus presently commercially available, consisting of two tanks, both of which are connected by tygon, or similar, tubing to a mixer/dispenser. One of the tanks contains the resin and the other tank contains the catalyst in such proportion that mixing the contents of the two tanks causes the foam to be generated and then to harden. In the present invention, a number of pairs of tanks with associated tubing and mixer/dispensers, may be disposed in a fixture instead of the number of foam generating capsules described in the preceding paragraph. This results in another implementation of the method described in the preceding paragraph.

In either method a predetermined number of foam generating capsules are placed at a predetermined depth within the well. If it then becomes necessary at any time to plug the well, to block it off in case of a fire or in case of salt water intrusion, for example, it is merely necessary to activate the preplaced foam generating capsules by electrical signals from the top. The foam generating capsules will then produce sufficient foam under pressure to fill the well hole and harden in place, thus, plugging up the well. At a future time, if it again becomes desirable to continue drilling in that hole, this may be accomplished by drilling right through the hardened foam plug.

DETAILED DESCRIPTION OF THE INVENTION

Figure 3:
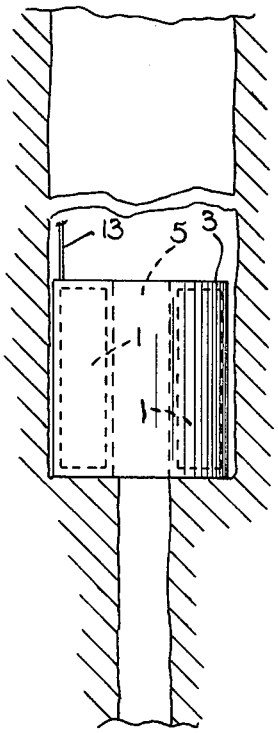
FIG. 3 is a cross-section of an oil well bore hole showing a frame containing foam producing capsules in place.

In one preferred embodiment of the present invention, a number of capsules (1) such as described in U.S. Pat. No. 3,726,340 or the like, may be disposed around the centerline longitudinal axis of a frame (3) formed generally in the shape of a cylinder of circular cross-section having a cylindrical aperture (5) running through the frame (3) coaxial with the frame centerline. The entire assembly may be placed within the well at a desired depth as shown in FIG. 3. This may be accomplished by drilling an oversized hole (B1) to the desired depth. The diameter of the oversized hole should be slightly in excess of the outside diameter of the frame (3). The invention then may be lowered within the well to the desired depth. Drilling of the well may then continue by running a drill of the desired well diameter down through the center aperture (5) of the invention. The remainder of the drilling process may proceed normally with the invention in place, to produce the normal drill hole of the desired diameter (B2).

Figure 1:
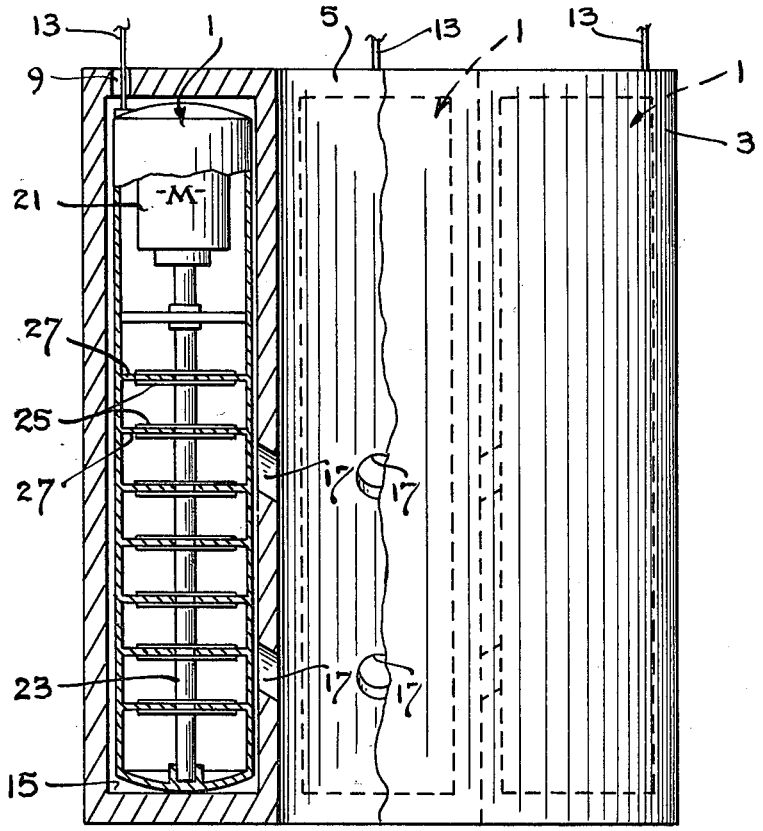
FIG. 1 shows a frame partially cut away to display one capsule, which capsule is also partially cut away to disclose the foam making mechanism.
Figure 2:
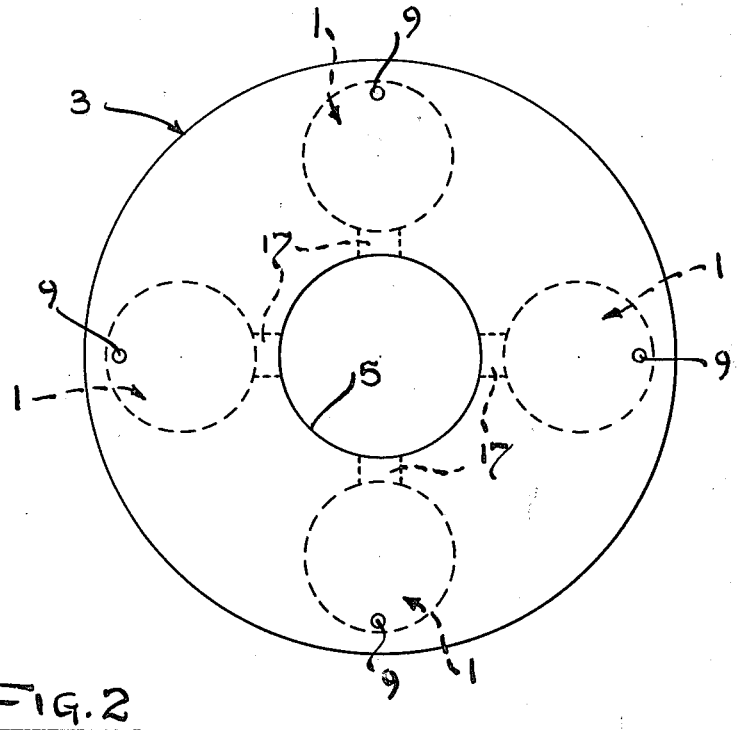
FIG. 2 is an end view of a frame.

In FIG. 1, a portion of the frame (3) is cut away to show one capsule (1) in place. Each capsule is contained in a hollow cylindrical space (15) with closed ends. An aperture (9) may exist through the top of the frame (3) to allow power supply leads (13) for the motor to pass through the frame (3). Alternatively, the capsule may contain a battery and sensor and switching means responsive to signals transmitted from the well head, thus obviating the need for power supply leads. A number of parts may be located to provide passage for foam between each hollow cylindrical space (15) and the central cylindrical aperture (5). Each such part may be disposed so as to direct foam generated within the hollow cylindrical aperture (5) and in a generally downward direction.

When it is desired to block the drill hole in order to stop a blowout, stop a fire in the hole, or stop off a saltwater intrusion, the motors (21) of each capsule (1) may be energized through the power supply leads (13). Energization of each motor (21) will then cause rotation of the associated capsule shaft (23), in turn causing the blades (25) to fracture the barriers (27) between the various chambers, allowing the ingredients to mix together. This will then cause the foam to be generated. The expanding foam will fracture the cylinder walls. The pressure caused by the expanding foam will force the foam to flow through the parts (17). The accumulation in the central cylindrical aperture (5) of the foam output from all of the capsules (1), through all of the parts, will saturate the cylindrical aperture and harden, thus plugging up the well. Of course, those skilled in the art will recognize that this embodiment may also be achieved by substituting in place of each of the motor-driven, foam generating capsules, an apparatus such as is presently widely used for generating foam commercially. Such an apparatus, comprising two tanks, one containing resin and the other containing catalyst, connected by tubing to a mixer/dispenser, may be packaged to be disposed in a frame as described above. The output of the mixer/dispenser may be directed to the parts and the operation may proceed as previously described.

Figure 4:
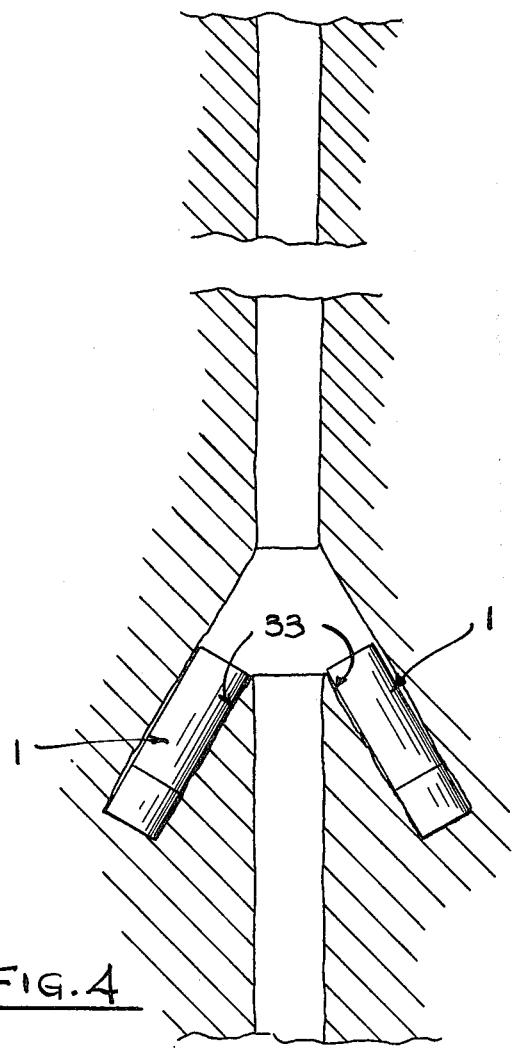
FIG. 4 is a cross-section of an oil well bore hole showing two slant drilled cavities each containing one foam producing capsule.

Alternatively, as depicted in FIG. 4, a number of capsules (1) may be disposed around the primary bore hole (B3) in slant drilled cavities (33). When it is desired to plug up the main bore hole of the well, each foam generating capsule may be energized as previously described. The slant drilled cavities (33) will act as their own parts to direct the foam, which is being generated under pressure, to the main bore hole (B3). As previously described, this foam will saturate the bore hole and harden, thus plugging the well.

Those skilled in the art will perceive many variations in the arrangement of the foam producing capsules within frames, or within predrilled cavities at a predetermined depth in an oil well. All these variations are encompassed within the present disclosure which is described by the following claims:

I claim:

1. A device for plugging wells, when required, comprising:

a plurality of foam generating capsules, each comprising
- a series of frangible compartments
- a power unit including motor means
- mixing means responsive to said motor means such that operation of said motor means causes fracture of the adjacent walls of said frangible compartments and intermixing of the contents of said frangible compartments
- foam producing ingredients stored in said frangible compartments so as to be inert before mixing and to actively generate foam when the contents of adjacent frangible compartments are mixed
- a fixture for maintaining said plurality of foam generating capsules disposed in a circular pattern around the centerline of the well comprising
  - a clear central aperture large enough for a well drill string (not part of the present invention) to pass through, and
  - a plurality of ports so located and shaped as to direct foam generated by said capsules into said clear central aperture.

2. The device of claim 1 wherein said power unit includes battery means for storing electric power sufficient to operate said motor means and sensor and switching means for operating said motor means responsive to a command transmitted from the well head.

3. A device for plugging wells, when required, comprising:

a plurality of foam generating apparatus, each comprising
- a tank containing resin
- a tank containing catalyst
- inter-connecting tubing means
- mixer/dispenser means
- control means for operating said mixer/dispenser responsive to remotely generated signals a fixture for maintaining said plurality of foam generating apparatus disposed in a circular pattern around the centerline of the well comprising
- a clear, central aperture large enough for a well drill string (not part of the present invention) to pass through, and
- a plurality of parts so located and shaped as to direct foam generated by said capsules into said clear central aperture.

4. A method of plugging wells on command comprising:

the placing of a plurality of foam generating capsules, each capable of generating large volumes of foam on command, disposed around the centerline of the well sufficiently displaced from the centerline of the well to allow drilling to continue without interference from said capsules, at a predetermined depth in the well, the activation of said foam generating capsules, on command, causing foam to be produced and forced into the well hole where it will harden, forming a plug.

5. The method of claim 4 wherein the placing of a plurality of said foam generating capsules comprises placing said capsules in a circular cylindrical frame containing a clear central aperture of sufficient diameter to allow a well drill string (not part of the present invention) to pass through without interference, enlarging the diameter of the well to the predetermined depth for the placing of said capsules by drilling to that depth with an oversized drill producing an upper portion well diameter not less than the outside diameter of said circular cylindrical frame, and lowering said circular cylindrical frame through the upper portion of the well.

6. The method of claim 4 wherein said placing of a plurality of foam generating capsules comprises drilling a plurality of side pockets at a predetermined depth around the outer wall of an oil well, into each said side pocket, placing one of said foam generating capsules in such an orientation that, upon activation of the motor, the foam will be forced toward the centerline of the well.

* * * * *